US012410683B2

(12) United States Patent
Carriere et al.

(10) Patent No.: US 12,410,683 B2
(45) Date of Patent: Sep. 9, 2025

(54) VALVE, METHOD, AND SYSTEM

(71) Applicant: Baker Hughes Oilfield Operations LLC, Houston, TX (US)

(72) Inventors: Marc Carriere, Calgary (CA); Justin Hibbs, Calgary (CA)

( * ) Notice: Subject to any disclaimer, the term of this patent is extended or adjusted under 35 U.S.C. 154(b) by 0 days.

(21) Appl. No.: 18/394,505

(22) Filed: Dec. 22, 2023

(65) Prior Publication Data

US 2025/0207478 A1 Jun. 26, 2025

(51) Int. Cl.
*E21B 34/06* (2006.01)
*E21B 34/14* (2006.01)

(52) U.S. Cl.
CPC ..... *E21B 34/142* (2020.05); *E21B 34/063* (2013.01); *E21B 2200/04* (2020.05); *E21B 2200/06* (2020.05)

(58) Field of Classification Search
CPC .. E21B 34/142; E21B 34/063; E21B 2200/06; E21B 2200/04
See application file for complete search history.

(56) References Cited

U.S. PATENT DOCUMENTS 9,752,411 B2 * 9/2017 Adam ..... E21B 34/14
10,961,818 B2 3/2021 Inglis et al.
11,454,074 B2 9/2022 Kellner et al.
2005/0230151 A1 * 10/2005 McGarian ..... E21B 41/0042 175/61
2007/0107944 A1 * 5/2007 Lee ..... E21B 10/322 175/317
2011/0315389 A1 * 12/2011 Crider ..... E21B 21/103 166/329
2012/0227973 A1 * 9/2012 Hart ..... E21B 21/103 166/329
2016/0273322 A1 * 9/2016 Russo ..... E21B 43/12
2017/0022783 A1 * 1/2017 Yong ..... E21B 34/10
2023/0279736 A1 * 9/2023 Eriksen ..... E21B 17/1078 166/192
2024/0167363 A1 * 5/2024 Arabskyy ..... E21B 34/142

OTHER PUBLICATIONS

AirGlide Floatation Sub; 2 pages; Halliburton 2022; https://www.halliburton.com/en/products/airglide-floatation-sub.

* cited by examiner

*Primary Examiner* — Taras P Bemko
(74) *Attorney, Agent, or Firm* — Baker Hughes Company

(57) ABSTRACT

A valve, including a housing having a port, a valve member positioned to selectively, adjustably, and repeatably obstruct, unobstruct, and partially obstruct the port solely by interaction with an untethered object, an indexer operably connected to the valve member; and an object profile in operable contact with the indexer. A method for managing a wellbore, including dropping an object to land on the object seat of a valve, cycling the indexer, moving the valve member to a position dictated by the indexer, changing the object on the profile, and releasing the object after changing the object. A borehole system, including a plurality of valves, each object profile of the plurality of valves having a different dimension. A wellbore system, including a borehole in a subsurface formation, a string in the borehole, and a valve disposed within or as a part of the string.

20 Claims, 5 Drawing Sheets

VALVE, METHOD, AND SYSTEM

BACKGROUND

In the resource recovery and fluid sequestration industries valves are often used to control fluid fronts to optimize production of desired fluids or optimize the formation acceptance of sequestration fluids. Such valves work well for their purposes but require interventions to move them either the first time or after the first time. Interventions generally require a shutdown of operations and the transportation of significant equipment, all of which is time-consuming and expensive. The art would positively receive improvements.

SUMMARY

An embodiment of a valve, including a housing having a port, a valve member positioned to selectively, adjustably, and repeatably obstruct, unobstruct, and partially obstruct the port solely by interaction with an untethered object, an indexer operably connected to the valve member; and an object profile in operable contact with the indexer.

An embodiment of a method for managing a wellbore, including dropping an object to land on the object seat of a valve, cycling the indexer, moving the valve member to a position dictated by the indexer, changing the object on the profile, and releasing the object after changing the object.

An embodiment of a borehole system, including a plurality of valves, each object profile of the plurality of valves having a different dimension.

An embodiment of a wellbore system, including a borehole in a subsurface formation, a string in the borehole, and a valve disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
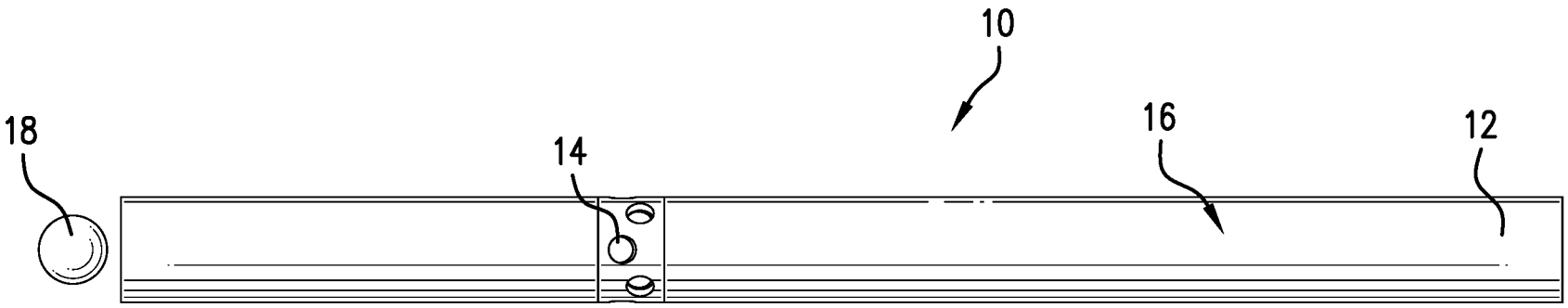
FIG. 1 is a side view of a valve as disclosed herein.
Figure 2:
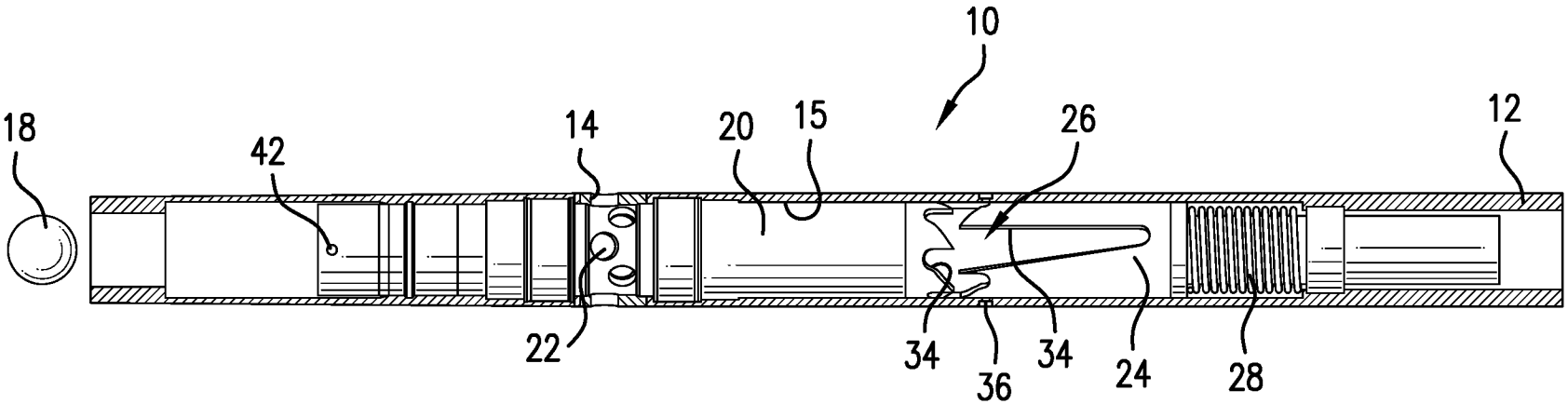
FIG. 2 is the view of FIG. 1 with the outermost portions transparent.

Referring to FIGS. 1 and 2, a valve 10 is illustrated in whole (FIG. 1) and with transparent outer components (FIG. 2). The valve 10 includes a housing 12 having one or more ports 14 extending from an inside surface 15 through a wall thickness to an outside surface 16. An object 18 is illustrated prior to engaging the valve 10. While the object 18 is illustrated as a ball, this is by no means limiting. The object 18 may be a ball, a dart, or any other untethered object having any geometric shape that might be desired for a particular application. The object 18 must be able to travel through a string (generally illustrated in FIG. 8) connected to the valve 10 to ensure the object 18 can at a selected time engage the valve 10 to have an effect as described hereunder.

In FIG. 2, the housing 12 has been rendered transparent to illustrate the internal components of the valve 10. These include a valve member 20 having one or more ports 22 therein. In this embodiment the valve member 20 is illustrated as a sleeve but could be configured differently and have the same effect. The valve member 20 is operably connected to an indexer 24 that may include a J-slot 26 and a biaser 28, that may be a coil spring or similar. Also included is an object profile 30 that may be configured as an actuating profile or an object seat, for example, that is configured to receive the object 18 and create a pressure drop in fluid applied to the object across the object 18 and seat 30 combined. Such a pressure differential will cause the following components, valve member 20, indexer 24 and seat 30 to move relative to the housing 12 thereby compressing the biaser 28. Relief of the applied pressure on the object 18/object seat 30 will allow the biaser 28 to uncompress and cause an indexing operation of the indexer 24. It will be appreciated that the path of the J-slot 26 includes camming surfaces 34 that when contacting a cam 36 disposed in the housing 12 causes both rotation of the indexer 24 and longitudinal positioning depending upon how long individual slots of the J-slot 26 are when aligned with the cam 36. The longitudinal positioning of the indexer 24 causes the same longitudinal positioning of the valve member 20 (unique to the particular slot). Accordingly, the position of the valve member 20 may be open, closed, choked, and differing levels of choked. The valve member 20 is actuable in either direction, i.e., toward closed or toward open for the life of the valve 10 and therefore is not limited by movement in a single direction as valves of the art tend to be.

Figure 3:
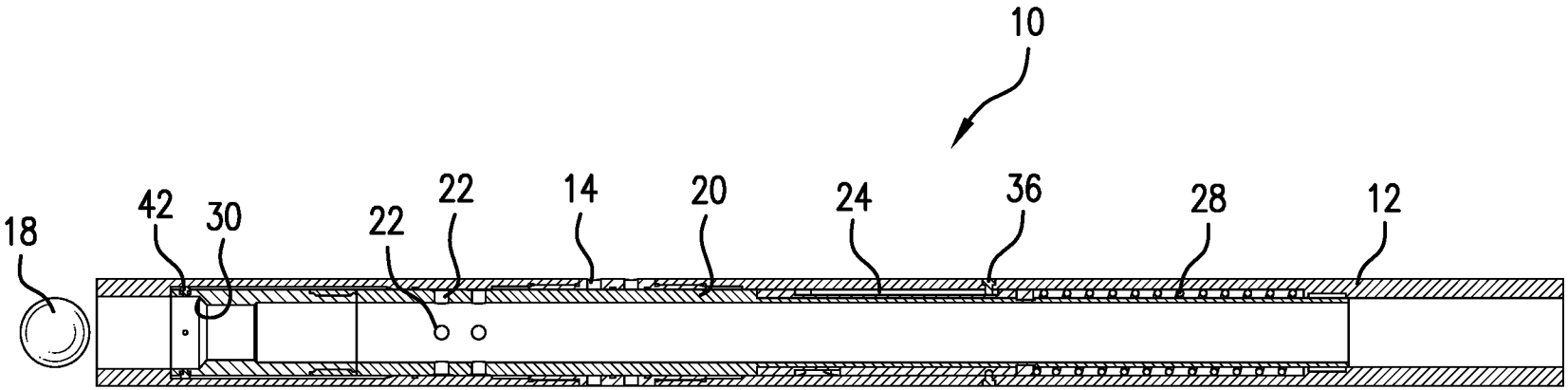
FIG. 3 is a sectional view illustrating the valve in a closed position.
Figure 4:
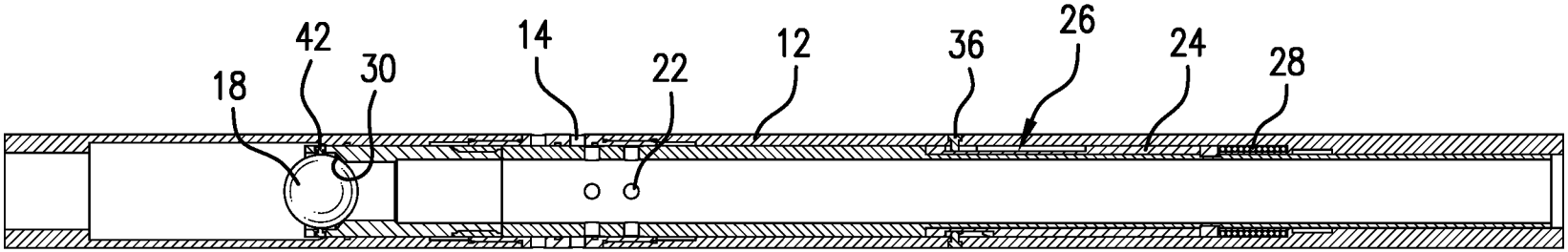
FIG. 4 is a sectional view illustrating the valve in an object on seat position with valve components shifted pursuant to hydraulic pressure on the object.
Figure 5A:
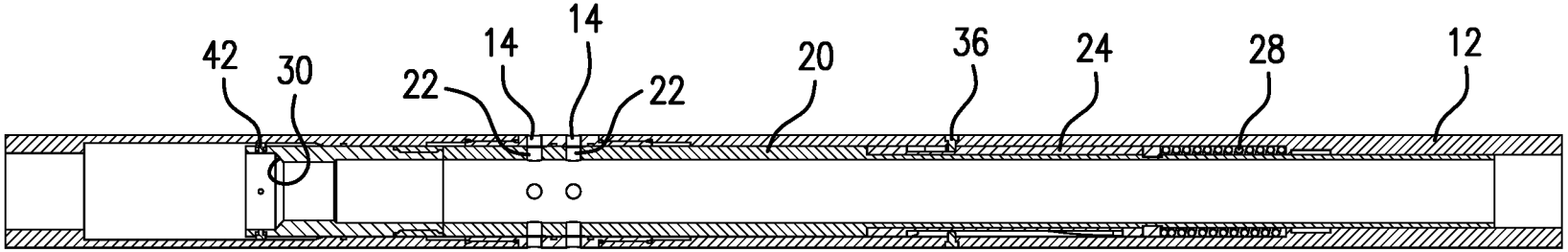
FIG. 5A is a sectional view of the valve in a fully open position subsequent to object disposal.
Figure 5B:
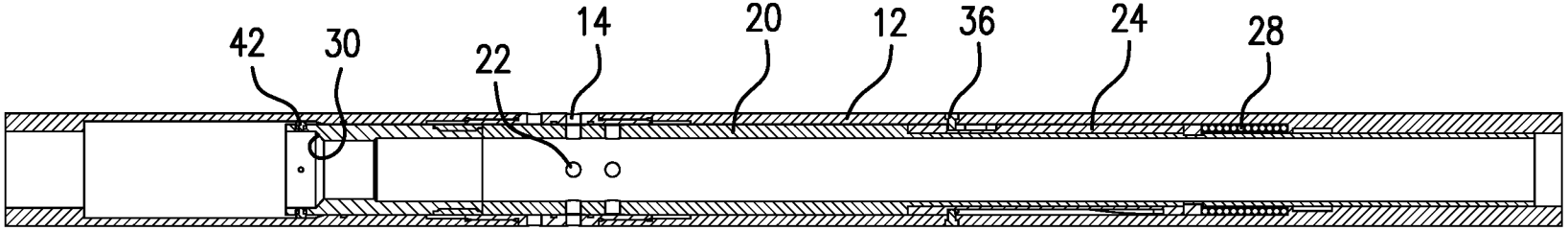
FIG. 5B is a sectional view of the valve in a partially (choked) open position subsequent to object disposal.

FIGS. 3-5 illustrate a single sequence of movements. FIG. 3 illustrates a run-in closed position, FIG. 4 illustrates landing an object 18 on the seat 30, where pressure has been applied to compress the biaser 28 and cycle the indexer 24 by one increment or one half increment (depending upon whether the indexer is configured to rotate upon stroke in one direction or is configured to rotate upon stroke in both directions, respectively). FIGS. 5A and 5B illustrate the valve 10 in a new position after disposal of the object 18, having been through one cycle of movement. FIG. 5A illustrated the valve 10 fully open with ports 14 and 22 all aligned for flow, while FIG. 5B illustrates a choked position where only some of the ports 22 are aligned for flow with ports 14. It will be appreciated that another object 18 could be landed on the seat 30 to again cycle the valve 10 and obtain a different position of the valve member 20 relative to the housing 12. The process may be repeated over and over to cycle the valve member position to any of the positions dictated by the indexer (which were decided when the indexer was manufactured).

Figure 6:
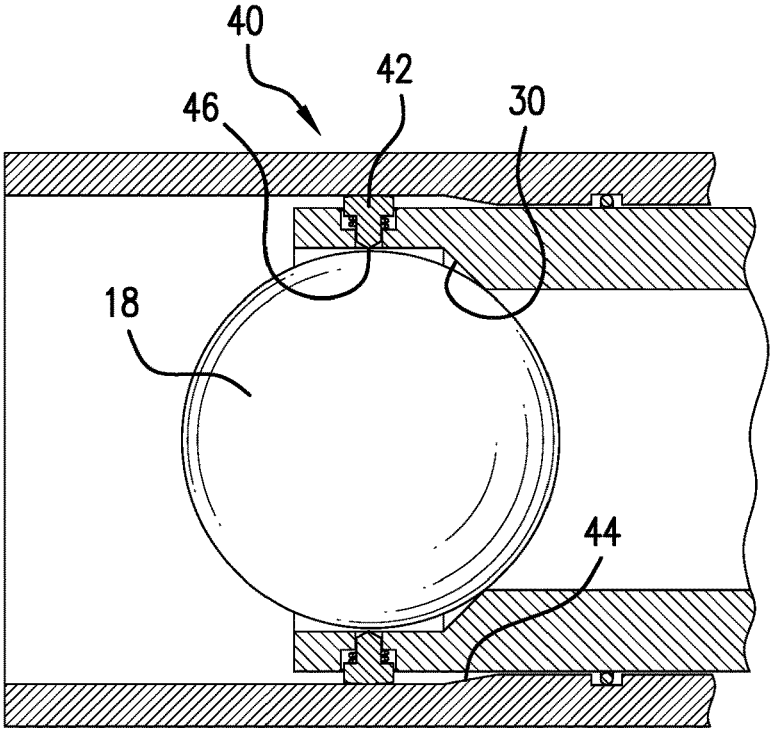
FIG. 6 is an enlarged view of the object seat and object prior to hydraulic pressure application.
Figure 7:
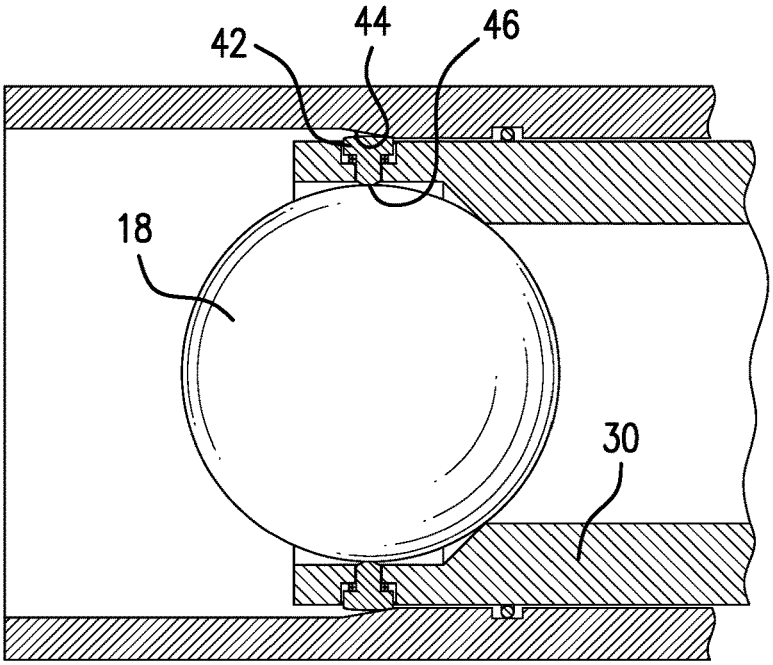
FIG. 7 is the view of FIG. 6 illustrating actuation of an embodiment of an object disposal configuration.

Disposal of the object 18 has been alluded to above but not described. Any means to remove the object from the seat 30 is contemplated as the ID of the valve 10 needs to be open for flow to occur. While disposal could include flowing the object back to surface (ditto for systems with multiple valves providing the actuation object geometry is unique to each valve 10), or degrading the object 18 if made at least in part of a degradable material such as a corrodible electrolytic metallic material or degrade-on-demand material both available from Baker Hughes, in accordance with the disclosure hereof, the object 18 may be disposed of by being broken down to a size and geometry that is too small to affect more downhole valves 10 from the one illustrated. In this case, the valve 10 will include an object breaker 40. In the illustrated embodiment, seen best in FIGS. 6 and 7, where this portion of the valve 10 is enlarged, one embodiment of the breaker 40 includes radially mobile load pins 42 and a geometric profile 44 of the housing 12 that actuates the load pins 42 automatically upon stroking of the seat 30 (compare positions in FIG. 6 and FIG. 7). The load pin 42 applies a point load at point 46 on the object 18 after the object 18, seat 30, valve member 20 and indexer 24 are shifted (to the right in the figure (see also FIG. 4). In FIGS. 6 and 7, it will be appreciated that the housing 12 includes the frustoconical inside surface or profile 44 that squeezes the load pins 42 radially inwardly to put the load on the object 18. The point loads on the object 18 cause fracturing of the object 18 and disassociation of the object 18 into a plurality (or a multiplicity) of smaller pieces. In embodiments, the object may employ a frangible material, as a material for a portion or the whole of the object 18.

The material may be glass, ceramic, carbide, porcelain, alloy, composites, plastic, metallic, polymer, cement, etc. providing the materials are frangible. "Frangible" for purposes hereof means the material will rupture or crumble into smaller pieces when impacted or sufficiently loaded against a stress riser. Combinations of materials including at least one of the materials hereinbefore identified are also contemplated. In embodiments, the load pins 42 are positioned to ensure the resulting pieces are too small in overall dimensions to actuate more downhole located valves 10. Load pins 42 may number one to as many as can be physically disposed in the seat 30. In FIG. 2, it is apparent that 4 are illustrated, for example. Configured as disclosed, the valve 10 is cyclable one time per object dropped with positioning of the valve subsequent to each cycle being dictated only by the J-slot 26. Additional valves 10 disposed further downhole from the one illustrated (but appear substantially as illustrated for the one in the figures) will employ a different geometry object 18 such as, for example, a smaller diameter ball. In each case, the object will be disposed of after a single pressure event to cycle that specific valve 10 in which the object was able, by geometry, to seat.

Figure 8:
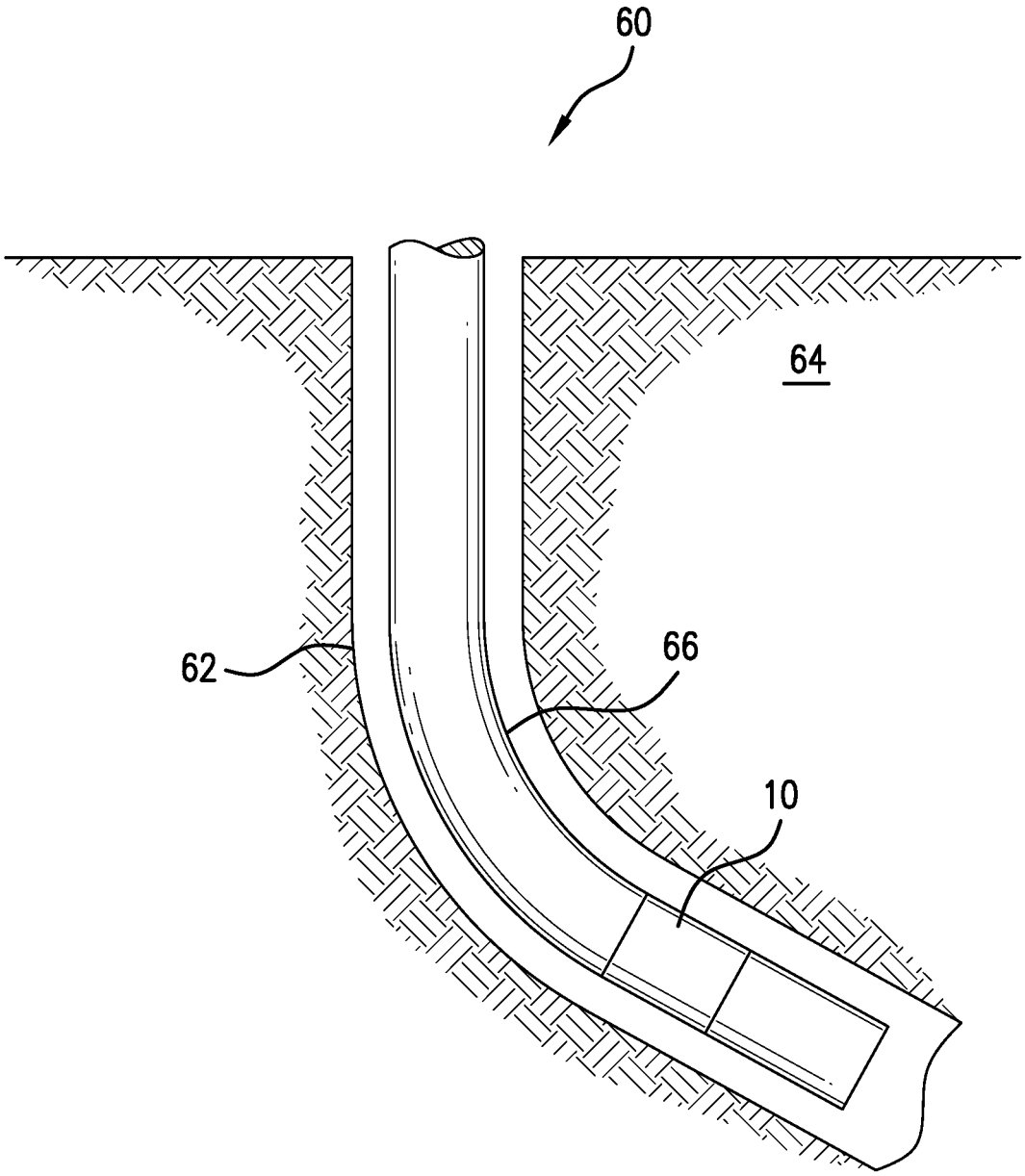
FIG. 8 is a view of a borehole system including a valve as disclosed herein.

Referring to FIG. 8, a borehole system 60 is illustrated. The system 60 comprises a borehole 62 in a subsurface formation 64. A string 66 is disposed within the borehole 62. One or more valves 10 as disclosed herein is/are disposed within or as a part of the string 66.

Set forth below are some embodiments of the foregoing disclosure:

Embodiment 1: A valve, including a housing having a port, a valve member positioned to selectively, adjustably, and repeatably obstruct, unobstruct, and partially obstruct the port solely by interaction with an untethered object, an indexer operably connected to the valve member; and an object profile in operable contact with the indexer.

Embodiment 2: The valve as in any prior embodiment, wherein the valve member is a sleeve, Embodiment 3: The valve as in any prior embodiment, wherein the indexer includes a J-slot.

Embodiment 4: The valve as in any prior embodiment, wherein the indexer includes a biaser.

Embodiment 5: The valve as in any prior embodiment, wherein the valve further includes an object breaker.

Embodiment 6: The valve as in any prior embodiment, wherein the object breaker is adjacent the object profile.

Embodiment 7: The valve as in any prior embodiment, wherein the object breaker includes a load pin that is loaded against an object landed on the object profile when the object profile is displaced in the housing.

Embodiment 8: The valve as in any prior embodiment, wherein the load pin is radially movable.

Embodiment 9: The valve as in any prior embodiment, wherein the breaker includes a plurality of load pins.

Embodiment 10: The valve as in any prior embodiment, wherein the plurality of load pins are arranged circumferentially about the object profile.

Embodiment 11: The valve as in any prior embodiment, wherein the untethered object includes a frangible material.

Embodiment 12: A method for managing a wellbore, including dropping an object to land on the object seat of a valve as in any prior embodiment, cycling the indexer, moving the valve member to a position dictated by the indexer, changing the object on the profile, and releasing the object after changing the object.

Embodiment 13: The method as in any prior embodiment, wherein the changing is breaking.

Embodiment 14: The method as in any prior embodiment, wherein the breaking is into a multiplicity of pieces.

Embodiment 15: The method as in any prior embodiment, wherein the object includes a frangible material.

Embodiment 16: The method as in any prior embodiment, wherein the changing is in a way that renders the object incapable of landing on a profile of another tool downhole of the valve.

Embodiment 17: The method as in any prior embodiment, wherein the another tool is another valve.

Embodiment 18: The method as in any prior embodiment, wherein the moving includes to a position among fully open flow, choked flow, or closed to flow and from any of fully open flow, choked flow, or closed to flow to another of fully open flow, choked flow, or closed to flow according to a each cycle of the indexer.

Embodiment 19: A borehole system, including a plurality of valves as in any prior embodiment, each object profile of the plurality of valves having a different dimension.

Embodiment 20: A wellbore system, including a borehole in a subsurface formation, a string in the borehole, and a valve as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers, Non compressible gases, etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A valve, comprising:

a housing having a housing port;

a valve member having a valve port, the valve member positioned to selectively, adjustably, and repeatably, in fixed positions, obstruct by misaligning the valve port with the housing port, unobstruct by fully aligning the valve port with the housing port, and partially obstruct by partially aligning the valve port with the housing port solely by interaction with a sequentially dropped one of a plurality of untethered objects having a substantially same size;

an indexer operably connected to the valve member; and an object profile in operable contact with the indexer, the profile configured to impart a mechanical load on the object to fragment the object while on the profile.

2. The valve as claimed in claim 1, wherein the valve member is a sleeve.

3. The valve as claimed in claim 1, wherein the indexer includes a J-slot.

4. The valve as claimed in claim 1, wherein the indexer includes a biaser.

5. The valve as claimed in claim 1, wherein the valve further includes an object breaker.

6. The valve as claimed in claim 5, wherein the object breaker is adjacent the object profile.

7. The valve as claimed in claim 5, wherein the object breaker includes a load pin that is loaded against an object landed on the object profile when the object profile is displaced in the housing.

8. The valve as claimed in claim 7, wherein the load pin is radially movable.

9. The valve as claimed in claim 7, wherein the breaker includes a plurality of load pins.

10. The valve as claimed in claim 9, wherein the plurality of load pins are arranged circumferentially about the object profile.

11. The valve as claimed in claim 1, wherein the untethered object includes a frangible material.

12. A method for managing a wellbore using an object of a plurality of objects having a substantially same size, comprising:

dropping the object to land on the object seat of a valve as claimed in claim 1;

cycling the indexer;

moving the valve member to a position dictated by the indexer;

imparting a mechanical load on the object to fragment the object while on the profile; and releasing the object through the unchanged profile after fragmenting the object.

13. The method as claimed in claim 12, wherein the changing is breaking.

14. The method as claimed in claim 13, wherein the breaking is into a multiplicity of pieces.

15. The method as claimed in claim 12, wherein the object includes a frangible material.

16. The method as claimed in claim 12, wherein the changing is in a way that renders the object incapable of landing on a profile of another tool downhole of the valve.

17. The method as claimed in claim 16, wherein the another tool is another valve.

18. The method as claimed in claim 12, wherein the moving includes to a position among fully open flow, choked flow, or closed to flow and from any of fully open flow, choked flow, or closed to flow to another of fully open flow, choked flow, or closed to flow according to a each cycle of the indexer.

19. A borehole system, comprising:

a plurality of valves as claimed in claim 1, each object profile of the plurality of valves having a different dimension.

20. A wellbore system, comprising:

a borehole in a subsurface formation;

a string in the borehole; and a valve as claimed in claim 1 disposed within or as a part of the string.

* * * * *